US006402094B1

(12) United States Patent
Beer

(10) Patent No.: US 6,402,094 B1
(45) Date of Patent: Jun. 11, 2002

(54) ARRANGEMENT FOR TRANSMITTING A SIGNAL FROM A TRANSMITTER TO A RAIL VEHICLE FOR POSITION FINDING AND INFORMATION TRANSMISSION

(75) Inventor: Kersten Beer, Braunschweig-Schapen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/674,938

(22) PCT Filed: May 5, 1999

(86) PCT No.: PCT/DE99/01395

§ 371 (c)(1),
(2), (4) Date: Dec. 28, 2000

(87) PCT Pub. No.: WO99/58388

PCT Pub. Date: Nov. 18, 1999

(30) Foreign Application Priority Data

May 8, 1998 (DE) ..... 198 22 114

(51) Int. Cl.[7] ..... B61L 23/00
(52) U.S. Cl. ..... 246/122 R
(58) Field of Search ..... 246/122 R, 124, 246/177, 178, 194, 193, 201, 219, 7, 34 B, 63 A; 701/19

(56) References Cited

U.S. PATENT DOCUMENTS

| | | | | |
|---|---|---|---|---|
| 3,700,886 A | * | 10/1972 | Birkin | 246/63 A |
| 3,740,549 A | * | 6/1973 | Thorne | 246/122 R |
| 4,166,599 A | | 9/1979 | Auer, Jr. et al. | |
| 4,471,356 A | * | 9/1984 | Gidl | 246/122 R |
| 5,711,497 A | * | 1/1998 | Andrianos et al. | 246/34 B |
| 6,234,428 B1 | * | 5/2001 | Bachtiger et al. | 246/7 |
| 6,317,664 B2 | * | 11/2001 | Oguma et al. | 701/19 |

FOREIGN PATENT DOCUMENTS

| | | |
|---|---|---|
| AT | 267 602 | 1/1969 |
| DE | 28 24 573 | 12/1979 |
| DE | 28 30 672 | 1/1980 |
| DE | 196 27 343 | 1/1998 |
| EP | 0 573 131 | 12/1993 |

OTHER PUBLICATIONS

E. Murr, "Der Ortungsrechner für die LZB 80–Fahrzeuggeräte", Signal and Draht 83 (1991), vol. 7/8, pp. 190–193.**

W. Braun et al., "Zugsicherungs– und Zugsteuerungssysteme bei der RBG Düsseldorf", Signal and Draht 81 (1989), vol. 7/8, pp. 135–141.**

* cited by examiner

*Primary Examiner*—Mark T. Le
(74) *Attorney, Agent, or Firm*—Kenyon & Kenyon

(57) ABSTRACT

An arrangement for transmitting a signal from a transmitter to a rail vehicle located on a segment of a track for position finding and information transmission is described. The transmitter is connected to a track conductor having crossing points installed in the track segment. The rail vehicle has a receiver unit which receives the transmitted signal and monitors it for phase jumps occurring during passage through the crossing points of vehicle. In order to achieve a particularly low-interference location finding, an occupancy sensor is installed at a point of entry of the track segment, which detects the entry of the rail vehicle into the track segment and generates an occupancy signal indicating the occupancy of the track segment. A switchover device assigned to the transmitter is connected to the occupancy sensor and activates the transmitter so that it transmits an unmodulated signal upon receiving the occupancy signal and transmits a modulated signal after a predefined time period thereafter has elapsed.

6 Claims, 1 Drawing Sheet

ARRANGEMENT FOR TRANSMITTING A SIGNAL FROM A TRANSMITTER TO A RAIL VEHICLE FOR POSITION FINDING AND INFORMATION TRANSMISSION

FIELD OF THE INVENTION

The present invention relates to an arrangement for transmitting a signal from a transmitter to a rail vehicle located on a segment of a track for position finding and information transmission. The transmitter is connected to a track conductor having crossing points installed in the track segment. The rail vehicle contains a receiver unit which receives the transmitted signal and monitors it for phase jumps occurring during passage through the crossing points of the track conductor for finding the location of the rail vehicle.

An arrangement of this type is described in German Patent Application No. 196 27 343. In this arrangement, a receiver unit is provided in or on a rail vehicle which receives a transmitted signal of a control station, supplied to a track conductor featuring crossing points. A flywheel oscillator is contained in the receiver unit, which generates a comparison signal from the received signal, the comparison signal having the same frequency as the received signal and being phase-synchronized with the received signal. The received signal is compared in the receiver unit with the comparison signal with respect to its phase angle as soon as the received signal has dropped below a lower threshold value and subsequently exceeded an upper threshold value; in such a case it is assumed that the received signal has crossed a zero amplitude point and the rail vehicle has passed through a crossing point of the track conductor. If it is established in this phase comparison between received and comparison signals that a 180° phase jump has occurred between the two signals, a crossing point identifier is generated, which is used for self-location of the rail vehicle.

The article "Der Ortungsrechner für die LZB 80 Fahrgeräte" (Position finding computer for LZB 80 locomotives"), E. Murr, Signal und Draht 83 (1991), 7/8, pp. 190–193), describes a rail vehicle-side antenna arrangement for vehicle-side detection of track conductor crossing points and thus for finding the location of the rail vehicle. This antenna arrangement has two pairs of antennas each having individual antennas spaced 9.90 meters apart. The passage through a crossing point can be detected from the vehicle with each of the two pairs of antennas by monitoring the output signals of both individual antennas of each pair of antennas for phase jumps.

The rail vehicle-side arrangement of two pairs of antennas is also described in the article "Zugsicherungs-und Zugsteuerungssysteme bei der RGB Düsseldorf" (Train safety and train control systems for the Düsseldorf railroad, W. Braun, S. Mura, *Signal und Draht* 81 (1989), Vol. 7/8, pp. 135–141). In this antenna arrangement one pair of antennas is installed on the first bogie and one of pair of antennas on the last bogie.

Austrian Patent No. 267 602 describes a counter that can be provided for measuring track segments from the vehicle, with which the passage through crossing points is counted.

SUMMARY

An object of the present invention is to provide an arrangement with which particularly low-interference position finding is possible.

This object is achieved according to the present invention by the fact that an occupancy sensor is installed at a point of entry of the track segment, which detects the entry of the rail vehicle into the track segment and generates an occupancy signal indicating the occupancy of the track segment, and a switchover device assigned to the transmitter is connected to the occupancy sensor and activates the transmitter so that it transmits an unmodulated signal upon receiving the occupancy signal and transmits a modulated signal after a predefined time period thereafter has elapsed, the predefined time period being of a duration such that it is sufficient for rail vehicle-side location finding.

One advantage of the arrangement according to the present invention is that a particularly low-interference location finding of the rail vehicle is achieved, because when the rail vehicle enters a track segment assigned to the control station, an unmodulated transmitted signal, initiated by the switchover device and supplied to the track conductor, is initially generated by the transmitter. This unmodulated transmitted signal is received by the receiver unit, from which the latter generates a phase-synchronized comparison signal which has a particularly high quality with respect to its synchronization with the received signal, because the transmitted signal is still unmodulated shortly after the rail vehicle has entered the track segment, i.e., before the predefined time period has elapsed, and therefore no synchronization errors caused by signal modulation occur in the comparison signal. Since the comparison signal thus has a particularly high degree of synchronization with the received signal, i.e., it is very accurately matched to the received signal with respect to its phase angle, a particularly accurate detection of the crossing points of the track conductor and thus a particularly accurate finding the location of the rail vehicle are possible.

After the predefined time period has elapsed, which has a duration determined by the time period required for finding the location of the rail vehicle, the finding the location of the rail vehicle is completed and information transmission between the control station and the rail vehicle can be initiated.

The arrangement according to the present invention can be advantageously used in railroad stations where very accurate positioning of the rail vehicle at the platform and thus a highly accurate position finding of the rail vehicle is required. After the rail vehicle comes to a stop in the railroad station area, for example, after a predefined time period to be suitably set has elapsed or after the complete stop of the train has been detected by one or more sensors, information transmission from the control station to the stopped rail vehicle and vice versa can take place.

The arrangement according to the present invention can be manufactured in a particularly simple and therefore inexpensive manner if, for example the occupancy sensor is a rail contact or is formed by a track circuit. The operation of track circuits is described, for example, in European Patent No. 573 131.

The present invention also relates to a method of transmitting a signal to a rail vehicle located on a segment of a track for position finding and information transmission, in which the transmitted signal is supplied to a track conductor installed in the track segment and having crossing points using a transmitter, and the transmitted signal is received using a receiver unit of the rail vehicle and is monitored for phase jumps occurring during passage through the crossing points of the track conductor for finding the location of the rail vehicle.

Such a method is also described in German Patent Application No. 196 27 343.

In order to achieve a particularly error-free position finding of the rail vehicle with such a method, according to the present invention, occupancy of the track segment by the rail vehicle is determined and the transmitter is activated so that it transmits an unmodulated signal for position finding when occupancy has been determined. It transmits a modulated signal for information transmission after a predefined time period thereafter has elapsed, the predefined time period being of a duration such that it is sufficient for rail vehicle-side location finding.

The method according to the present invention can be carried out in a particularly inexpensive and therefore advantageous manner if a track circuit or a rail contact is used for determining occupancy.

BRIEF DESCRIPTION OF THE DRAWING

The FIGURE shows an example embodiment of the present invention.

DETAILED DESCRIPTION

Figure 1:
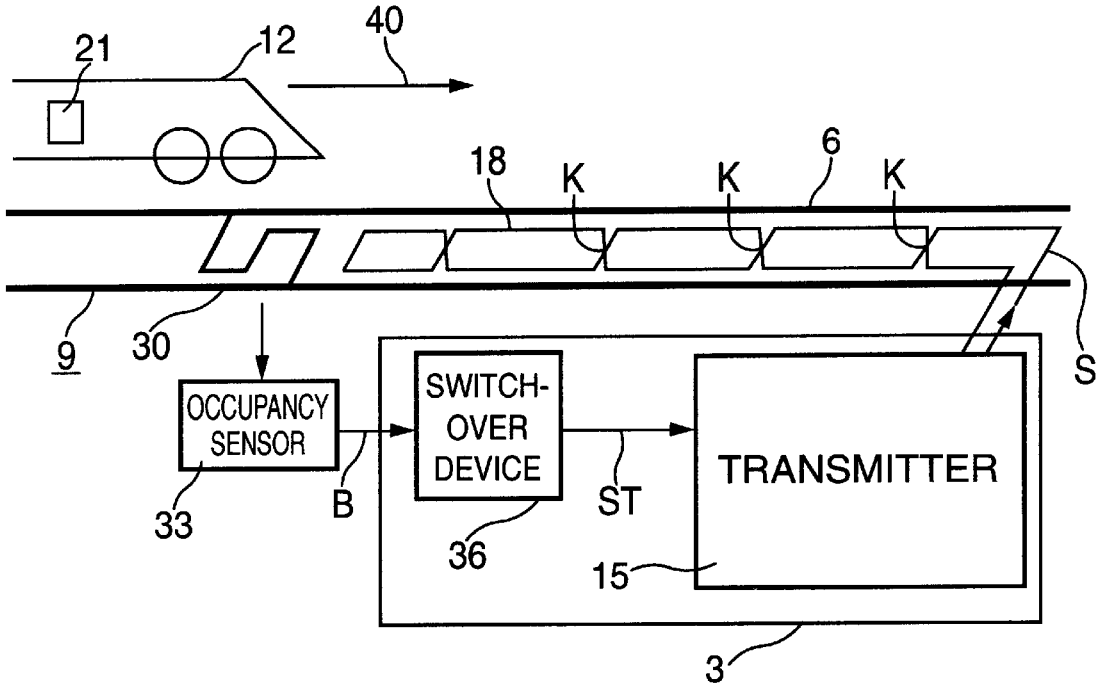

The figure shows an arrangement for transmitting a transmitted signal S from a control station 3 to a rail vehicle 12 located on a segment 6 of a track 9 assigned to control station 3 for position finding and information transmission. Control station 3 has a transmitter 15 which supplies signal S to a track conductor 18 installed in track segment 6 and having crossing points K. A receiver unit 21, which receives signal S of transmitter 15 located at control station 3 and evaluates it in order to find the location of rail vehicle 12 in track segment 6, is provided in or on rail vehicle 12. Specifically, receiver unit 21 monitors the received signal for phase jumps occurring during passage through crossing points K of track conductor 18 by comparing the phase of the received transmitted signal with that of a comparison signal formed in receiver unit 21 from the received signal. Receiver unit 21 in rail vehicle 12 can be designed as described in detail in abovementioned German Patent Application No. 196 27 343, in particular in FIG. 2 with the respective figure description. An occupancy sensor 33 is installed at a point of entry 30 of track segment 6, which detects the entry of rail vehicle 12 in track segment 6 and transmits an occupancy signal B to control station 3 indicating the occupancy of track segment 6. For this purpose, occupancy sensor 33 is connected to a switchover device 36 at control station 3 which is in turn connected to transmitter 15 at control station 3. Switchover device 36 controls, via appropriate control signals ST, transmitter 15 at control station 3, so that transmitter 15 supplies an unmodulated signal S to track conductor 18 of track segment 6 upon receiving occupancy signal B. A time delay element (not illustrated) is also contained in switchover device 36, and it switches over transmitter 15, via a suitable control signal ST using a corresponding activation, to a modulated transmission mode and thus to the transmission of a modulated signal S after a predefined time period after receipt of occupancy signal B from occupancy sensor 33. Occupancy sensor 33 may be a rail contact or a track circuit with which the passing of rail vehicle 12 overtrack segment 6 is detected. Switchover device 36 with its time delay element can be formed, for example, by a suitably programmed computer connected to transmitter 15 which activates transmitter 15.

In summary, finding the location of the rail vehicle and information transmission are carried out using the above-described arrangement as follows: when rail vehicle 12 enters track segment 6 along arrow 40, which is detected by occupancy sensor 33, transmitter 15 of control station 3 is switched to an unmodulated transmission mode by switchover device 36. Unmodulated transmitted signal S is received by receiver unit 21 of rail vehicle 12. A comparison signal is generated in receiver unit 21 from the received signal, which is phase synchronized with the received signal. If the amplitude of the received signal then drops below a lower threshold value and subsequently exceeds an upper threshold value again, receiver unit 21 assumes that the received signal has passed through a zero crossing, which is assumed to have been caused by a passage through a crossing point K of track conductor 18. Because a phase jump of 180° must also occur during such a passage through one of crossing points K of track conductor 18, the comparison signal is compared to the received signal to make sure that rail vehicle 12 has actually passed through a crossing point, and to achieve accurate tracking of rail vehicle 12; if it is determined that the expected 180° phase jump has occurred, a crossing point signal indicating passage through a crossing point K of track conductor 18 is generated in receiver unit 21 in rail vehicle 12, and the signal is used in rail vehicle 12 for rail tracking. After a predefined time period has elapsed, which is defined as a function of different parameters such as the distance of the crossing points of track conductor 18 from one another or the average speed of entry of rail vehicle 12 into rail section 6, switchover device 36 switches over from the unmodulated transmission mode to the modulated transmission mode. Subsequently, information transmission between control station 3 and rail vehicle 12 then becomes possible using the modulated transmission mode. The arrangement illustrated in the figure can be used in a particularly advantageous manner, for example, in railroad stations, if occupancy sensor 33 with its point of entry 30 is installed before the railroad station area as viewed in the direction of travel, so that the entry of rail vehicle 12 into the railroad station area is detected in a timely manner. In this case, transmitter 15 of control station 3 is switched to unmodulated transmission mode in order to achieve highly accurate tracking of rail vehicle 12 in track segment 6. If rail vehicle 12 has reached its final position at the railroad station, which is required in particular for modern urban and commuter trains, the system switches to modulated transmission mode, whereby information transmission between control station 3 and rail vehicle 12 becomes possible.

What is claimed is:

1. An arrangement for transmitting a signal for position finding to a rail vehicle located on a track segment of a track, comprising:

a track conductor having crossing points and installed in the track segment;

a transmitter coupled to the track conductor, the transmitter transmitting a signal for position finding;

a receiver in the rail vehicle that receives the signal and monitors the signal for phase jumps occurring during passage through the crossing points of the track conductor for finding a location of the vehicle;

an occupancy sensor installed at a point of entry of the track segment, the occupancy sensor to detect entry of the rail vehicle into the track segment and to generate an occupancy signal indicating an occupancy of the track segment; and a switchover device assigned to the transmitter and coupled to the occupancy sensor, the switchover device to activate the transmitter so that the transmitter transmits an unmodulated signal upon the switchover device receiving the occupancy signal and transmits a modulated signal after a predefined time period has elapsed, the predefined time period being a duration sufficient for rail vehicle location finding.

2. The arrangement according to claim 1, wherein the occupancy sensor is a rail contact.

3. The arrangement according to claim 1, wherein the occupancy sensor is formed by a track circuit.

4. A method of transmitting a signal for position finding and information transmission to a rail vehicle located on a track segment of a track, comprising:

arranging a transmitter for supplying a transmitted signal to a track conductor installed in the track segment, the track conductor having crossing points;

arranging a receiver unit of the rail vehicle for receiving the transmitted signal;

monitoring the received signal for phase jumps occurring during passage through the crossing points of the track conductor for finding a location of the rail vehicle;

determining occupancy of track segment by the rail vehicle; and activating the transmitter to transmit an unmodulated signal for location finding when occupancy has been determined and to transmit a modulated signal for information transmission after a predefined time period has elapsed, the predefined time period being a duration sufficient for rail vehicle location finding.

5. The method according to claim 4, wherein the determining the occupancy step includes arranging a rail contact for determining the occupancy of the track segment.

6. The method according to claim 4, wherein the determining the occupancy step includes arranging a track circuit for determining the occupancy of the track segment.

* * * * *